US005738596A

United States Patent [19]

Meyer

[11] Patent Number: 5,738,596

[45] Date of Patent: Apr. 14, 1998

[54] IRON-TYPE GOLF CLUBHEAD

[75] Inventor: Dean E. Meyer, LaGrange Park, Ill.

[73] Assignee: Prince Sports Group, Inc., Bordentown, N.J.

[21] Appl. No.: 599,886

[22] Filed: Feb. 12, 1996

[51] Int. Cl.[6] ..... A63B 53/04

[52] U.S. Cl. ..... 473/350; 473/349

[58] Field of Search ..... 473/328, 349, 473/350

[56] References Cited

U.S. PATENT DOCUMENTS

| | | | |
|---|---|---|---|
| D. 256,264 | 8/1980 | Solheim . | |
| 1,320,163 | 10/1919 | Maurice . | |
| 3,655,188 | 4/1972 | Solheim . | |
| 3,814,437 | 6/1974 | Winquist . | |
| 3,947,041 | 3/1976 | Barber | 473/349 X |
| 4,326,326 | 4/1982 | MacDonald . | |
| 4,826,172 | 5/1989 | Antonious . | |
| 4,848,747 | 7/1989 | Fujimura et al. . | |
| 4,919,431 | 4/1990 | Antonious | 473/350 |
| 4,921,252 | 5/1990 | Antonious | 473/350 |
| 4,955,610 | 9/1990 | Creighton et al. . | |
| 4,957,294 | 9/1990 | Long . | |
| 5,026,056 | 6/1991 | McNally et al. . | |
| 5,046,733 | 9/1991 | Antonious . | |
| 5,048,834 | 9/1991 | Gorman . | |
| 5,242,167 | 9/1993 | Antonious . | |
| 5,312,105 | 5/1994 | Cleveland . | |
| 5,326,106 | 7/1994 | Meyer . | |
| 5,328,184 | 7/1994 | Antonious . | |
| 5,390,924 | 2/1995 | Antonious | 473/328 |
| 5,401,021 | 3/1995 | Allen . | |
| 5,419,560 | 5/1995 | Bamber . | |
| 5,429,353 | 7/1995 | Hoeflich | 473/350 |
| 5,492,327 | 2/1996 | Biafore, Jr. | 473/350 X |
| 5,549,297 | 8/1996 | Mahaffey | 473/350 X |
| 5,586,947 | 12/1996 | Hutin | 473/350 X |
| 5,595,552 | 1/1997 | Wright et al. | 473/350 X |

OTHER PUBLICATIONS

Competitive Edge Golf, Sep. 1995, pp. 4–5, 8–9, 17.

*Primary Examiner*—Raleigh W. Chiu
*Attorney, Agent, or Firm*—White & Case L.L.P.

[57] ABSTRACT

An iron-type golf clubhead includes a blade, a hosel, and a junction. The blade includes a rearwardly facing blade cavity, and the junction includes a rearwardly facing junction cavity that is coextensive with the blade cavity. A graduated weight pad is located within the blade cavity and preferably has a height, in a direction perpendicular to the blade face, that varies in a toe-to-heel direction, and which may also vary from the top to the bottom of the club. The junction cavity may also include a negative weight cutout that extends below the junction cavity floor and that represents a continuation of the profile of the weight pad, in effect forming a negative weight pad. The junction cavity and weight pad act to move the center of gravity outwardly toward the toe, and also to increase the sweet spot on the outer, toe portion of the clubhead.

24 Claims, 4 Drawing Sheets

IRON-TYPE GOLF CLUBHEAD

BACKGROUND OF THE INVENTION

The present invention relates to iron-type golf clubs.

There have been many proposals in the past for improving the performance of golf irons, by redistributing the mass of the clubhead relative to the center of the club face. One type of such club is the so-called cavity-back iron, in which a cavity is formed in the rear surface of the blade, such that most of the clubhead mass is distributed around the periphery of the blade, i.e., extends around the top and bottom edges, the toe, and the heel.

In my prior U.S. Pat. No. 5,326,106, I proposed a golf iron in which the blade and the hosel and junction (the latter being a generally curved portion connecting the hosel with the blade) are separate elements, in contrast to a conventional clubhead in which the hosel, junction, and blade are one piece. By doing so, it is possible to make the hosel and junction piece of a lighter material than the blade, and to transfer weight to the blade where it is more effective.

U.S. Pat. No. 5,222,734 discloses another way in which weight in the hosel can be reduced and shifted to the club head, by employing an iron having a short hosel.

SUMMARY OF THE INVENTION

The present invention is a cavity-back golf iron clubhead in which weight is substantially reduced in the junction area, but which does not require that the clubhead be made of two separate pieces or use a shortened hosel. Moreover, in accordance with the present invention weight is redistributed in a manner to shift the center of gravity of the clubhead toward the toe.

Studies have shown that a typical golfer tends to strike the ball not in the geometric center of the club face. Rather, the average striking location is toward the toe. The present invention thus relocates the center of gravity to a position approximating the average location of ball impact, and thereby makes it easier for the average golfer to hit a good shot.

More particularly, a clubhead according to the invention includes a hosel, a blade, and a junction connecting the hosel and blade. A cavity is formed in the rear surface of the blade. A cavity is also formed in the rear surface of the junction, preferably coextensive with the blade cavity.

Preferably, a graduated weight pad is disposed in the blade cavity. The weight pad has increasing thickness, and thereby mass, in the direction of the toe, to relocate the center of gravity toward the toe. The graduated weight pad also acts to extend the sweet spot further toward the toe end of the club face. The thickness of the weight pad at any given vertical position can be varied as well, to move the center of gravity location up or down relative to the bottom edge of the clubhead.

In a further preferred embodiment, the junction cavity includes a negative weight cutout that extends from the cavity floor into the body of the junction, which further reduces the weight of the junction.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
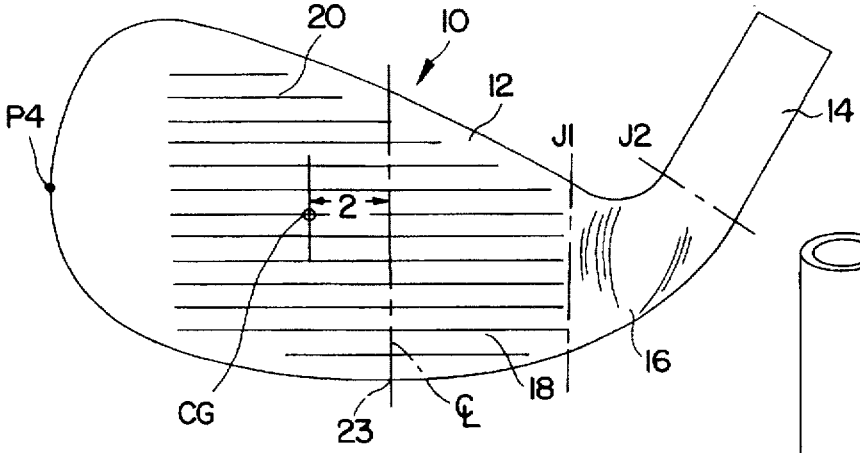
FIGS. 1–4 are front, rear, heel end, and top views, respectively, of a golf clubhead according to the invention.
Figure 3:
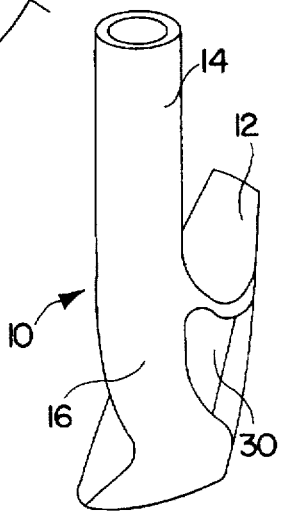

Referring to FIGS. 1–5, a golf clubhead 10 includes a blade 12, a hosel 14, and a junction 16. The junction 16 is the area between broken lines J1–J2, shown in FIGS. 1–2 and 4, and generally is the curving portion of the clubhead 10 that transitions from the blade, having a generally planar club face 18, to the hosel 14. The junction/blade boundary J1 is perpendicular to the grooves 20 and is located where the club face starts to diverge from flat. Normally, the boundary J1 between the blade and junction corresponds to the heel end edges of the club face grooves 20, but in some clubheads the grooves 20 may not extend all the way to the junction.

The hosel 14 typically is cylindrical or tapered, having a longitudinal axis 15 that is coaxial with the club shaft (not shown). The boundary J2 between the hosel 14 and junction 16 is that point where the axis perpendicular to the instantaneous cross-section begins to diverge from the shaft axis. As shown in FIG. 1, the junction 16 extends from the heel end of the blade initially in a generally toe-to-heel direction, before curving upwardly to connect to the hosel 14. As a result, the junction 16 spaces the hosel from the heel end of the blade such that the hosel axis 15 does not intersect the club face 18.

The clubhead 10 generally may be given any conventional configuration, except in the respects described below, and therefore need not be described in detail here. In the example, the clubhead 10 is a one-piece construction, e.g., made by casting, forging, or any other suitable method, and has a generally conventional oversize configuration. The grooves 20 are oriented so as to be parallel to the ground plane when the blade is resting on the ground at the correct lie angle. The lowest point on the blade, when resting in this position, is designated the touchpoint 23.

Figure 2:
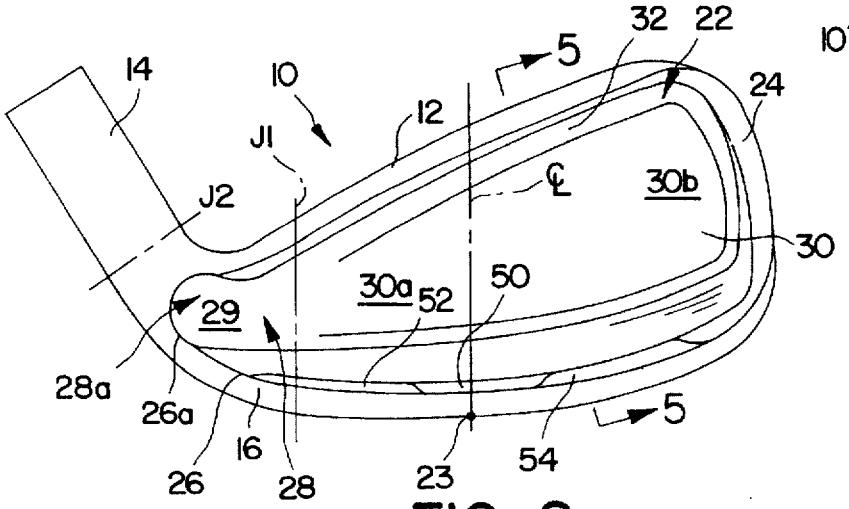
Figure 4:
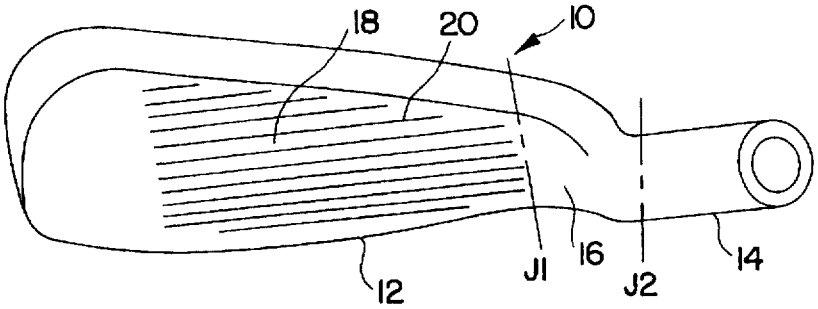

Referring to FIGS. 2 and 4, the rear face of the blade includes a blade cavity 22, which is defined by a continuous blade perimeter wall 24 extending rearwardly along the top edge, toe, and bottom edge the clubhead 10. However, unlike conventional cavity-back clubheads, the perimeter wall 24 does not enclose the blade cavity 22 at the heel end of the blade 12. Instead, the perimeter wall 24 joins with a junction perimeter wall 26 that defines a junction cavity 28 that is continuous with the blade cavity 22. As shown in FIG. 2, the junction cavity 28 initially extends in the same general direction as the blade cavity, but includes a portion **28*a*** that curves upwardly to follow the upwardly curving junction.

Preferably, the cavity floor 32 and junction cavity floor 29 each lie at least generally in a plane, and most preferably the same plane. As shown in FIG. 2, the junction cavity floor 29 extends a sufficient distance towards the heel as to intersect a plane which is oriented perpendicular to the junction cavity floor 29 and which contains hosel axis 15.

FIG. 1 shows the centerline "CL" of the blade, which extends vertically through the sole touchpoint 23, i.e., perpendicular to the grooves 20. FIG. 1 also shows the location of the center of gravity "CG" of the blade 12. Preferably, the blade center of gravity "CG" is offset from the centerline CL by a distance "z" which is at least 0.1 inches toward the toe side of the blade 12.

Referring to FIG. 2, the rear edge 50 of the sole of the blade 12 preferably includes a pair of flats 52, 54 located on the heel and toe sides, respectively, of the blade touchpoint 23, as described further below.

Figure 12:
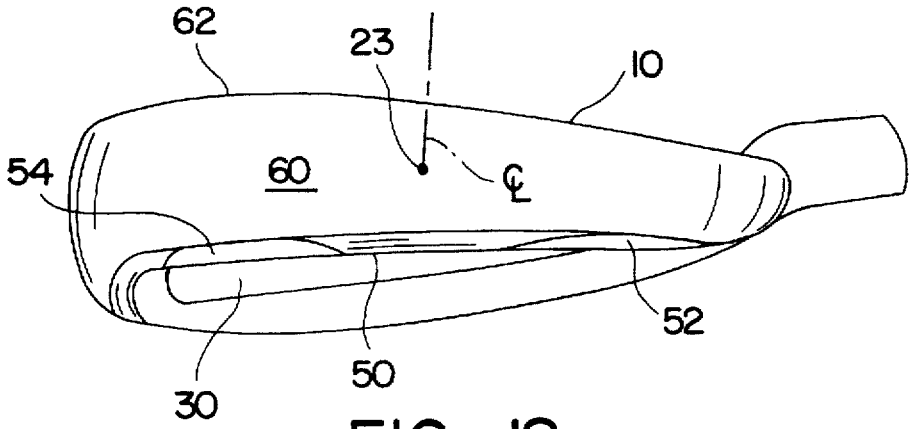
FIG. 12 is a bottom view of the clubhead of FIGS. 1–5.

Referring to FIG. 12, the bottom surface 60 of the clubhead 10 sole is curved along its length (i.e., heel-to-toe direction), and the hosel 14 is angled so that when the club is held at the correct lie angle, the clubhead will touch the ground at the touchpoint 23. When the clubhead is resting on the ground, the rear edge 50 of the sole, which is rounded, faces generally away from the leading edge 62 of the sole. On either side of the centerline CL, the rear edge 50 includes flat portions 52, 54, whose surfaces lie forward (i.e., in the direction toward the leading edge 62) of the rearmost surface of the rear edge 50.

The flats 52, 54, formed on the rear edge 60 of the sole, are provided for easier playability. With such flats, the sole edge will not catch upon take-away. Also, the club head is lie-adjustable at the address position.

Figure 5:
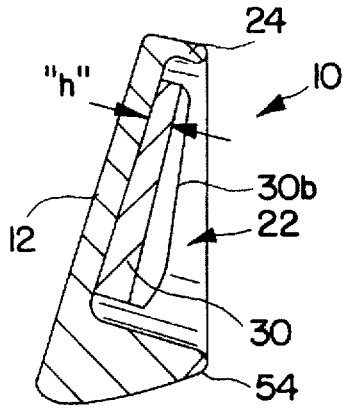
FIG. 5 is a sectional view of the clubhead, taken through lines 5—5 of FIG. 2.
Figure 6:
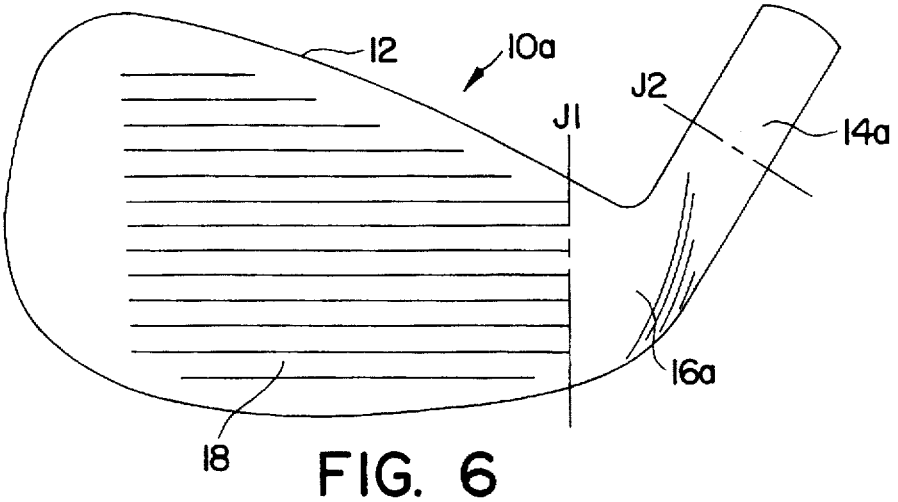
FIGS. 6–8 are front, rear, and heel end views, respectively, of an alternative embodiment.

Referring to FIGS. 2 and 5, the clubhead 10 also includes a graduated weight pad 30 that extends along the cavity floor 32. The weight pad 30 has a height "h" (see FIG. 5), in a direction perpendicular to the front face 18 of the blade 12, that increases from a minimum at near the heel end of the blade 12, designated **30*a* in FIG. 2, to a maximum at the toe end of the blade 12, designated 30*b*. As shown in FIG. 5, the height "h" at a midpoint between the heel and toe is less than the height at the toe 30*b*. Moreover, the height "h" of the weight pad 30, for any given vertical cross-section, is not necessarily uniform from top to bottom, but may vary, as shown in FIG. 5. In the example of FIGS. 1–5, the height "h" increases non-uniformly from the heel to the toe, and also increases from top to bottom of the clubhead. The weight pad may either be formed unitary with the blade, or be a separate member secured to the cavity floor 32**.

The junction cavity 28 serves to reduce the overall weight of the clubhead 10, taking weight from a region (i.e., the junction) that will not adversely affect the power of the club. Insofar as it is generally desirable to maintain a conventional clubhead weight, this weight may be redistributed to the blade 12. By utilizing a graduated weight pad 30, whose height "h" varies in a heel-to-toe direction, and which may optionally vary as well from the top to the bottom of the clubhead, it is possible to move the center of gravity "CG" (see FIG. 1) not only in a heel-to-toe direction, but also up or down relative to the ground. As discussed above, on average golfers tend to make contact with the ball closer to the toe, rather than in the geometric center of the club face 18. Thus, the invention allows the center of gravity to be moved so that it is coincident with the average ball contact point and so that the sweet spot is more centered about this location than in a conventional club, reducing the tendency of the clubhead 10 to twist upon ball impact, and providing greater control and distance.

Figure 13:
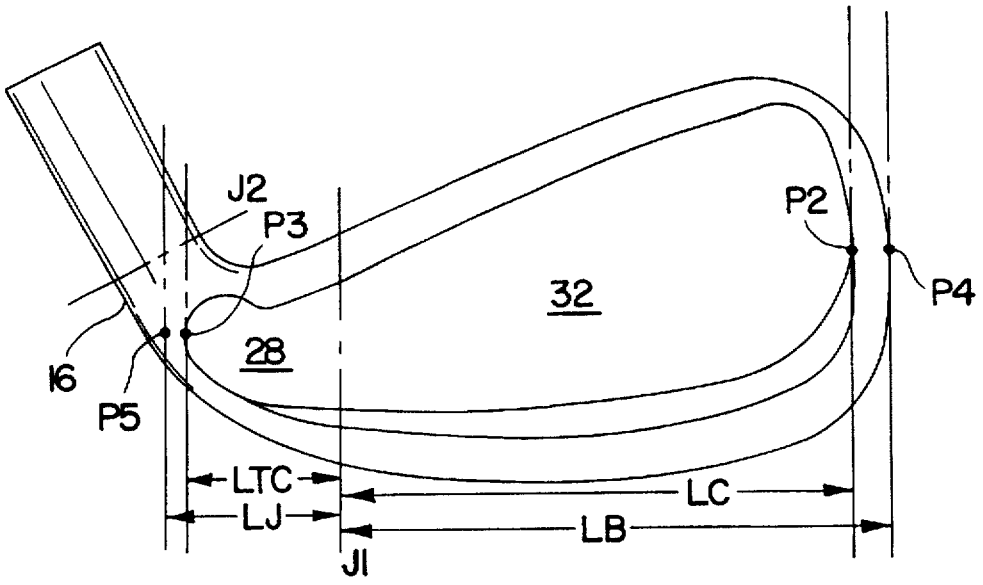
FIG. 13 is a rear view of the clubhead of FIGS. 1–5, illustrating a coordinate measuring system.

The preferred ranges of dimensions of the clubhead and cavities 32, 28 can be given with reference to FIG. 13. FIG. 13 is a rear view comparable to FIG. 2, but in which the weight pad 30 has been omitted for clarity. The blade cavity 32 has a length "LC" which represents the distance, measured along the cavity floor 32 in a direction perpendicular to J1 (i.e., parallel to the ground when the club is in the normal lie position), from the line J1 to furthest point P2 lying within cavity 32. The blade has a length "LB", which is the distance from J1 to the point P4 on the blade toe furthest away from J1, measured in a direction along the cavity floor 32 perpendicular to line J1.

Similarly, the junction cavity 28 has a length "LJC" which represents the distance, measured along the junction cavity floor 28, perpendicular to line J1, from J1 to the furthest point P3 within cavity 28. The junction 16 has a length "LJ", which is the distance from J1 to the point P5 on the junction outer surface furthest away from J1, measured in a direction along the cavity floor 32 perpendicular to line J1.

As used herein, the lengths "LC", "LB", "LJC", and "LJ" all refer to the length measured along the cavity floor in a direction parallel to the ground when the club is in its normal lie position. The lengths "LC" and "LB" represent the distance between the junction/blade boundary J1 and the furthest point lying within the blade cavity and on the blade toe, respectively. The lengths "LJC" and "LJ" represent the distance between the junction/blade boundary J1 and the furthest point lying within the junction cavity and on the junction outer surface, respectively.

As shown, point P5 does not lie at the extreme left of the junction 16, due to the fact that the junction 16 is curving away from the plane of the junction cavity floor 28, whereas the length LJ is measured in the plane of the junction cavity floor 28.

The blade cavity 32 preferably has a length "LC" of at least 2.75 inches. The junction cavity preferably has a length "LJC" of at least 0.1 inches, such that the blade cavity and junction cavity have a combined length LJC+LC of at least 2.85 inches. The blade 12 preferably has a length "LB" of at least 3.0 inches, and the junction 16 preferably has a length "LJ" of at least 0.6 inches, such that the clubhead has an overall length LJ+LB of at least 3.6 inches.

In an exemplary embodiment, the blade cavity 32 has a length "LC" of 2.85 inches, and the junction cavity 28 has a length "LJC" of 0.53 inches, for a combined length LC+LJC of 3.38 inches. The blade 12 has a length "LB" of 3.1 inches, and the junction 16 has a length "LJ" of 0.61 inches, for a combined clubhead length LB+LJ of 3.71 inches.

The length of the junction cavity "LJC" is preferably at least 17%, and most preferably at least 50%, of the length of the junction "LJ". In the exemplary embodiment described above, the junction cavity length "LJC" is 87% of the junction length "LJ", i.e., extends along most of the length of the junction.

Also, the combined cavity length LJC+LC is preferably at least 88%, and most preferably at least 90%, of the overall clubhead length LJ+LB. In the exemplary embodiment described above, the overall cavity length LJC+LC is 91% of the overall clubhead length LJ+LB.

Measurements were performed on various models of #5 irons comparing the present invention, where the cavity extends a substantial distance into the junction, with other cavity back clubs, and the results are listed in Table 1.

TABLE 1

| Club | Cavity Length LJC + LC (inches) | Clubhead Length LJ + LB (inches) | Cavity Percent |
|---|---|---|---|
| Zing 2 | 2.60 | 3.60 | 72 |
| Langert | 2.80 | 3.75 | 75 |
| TPS | 2.85 | 3.65 | 78 |
| Maxfli VHL | 2.70 | 3.40 | 79 |
| Lynx Black Cat | 2.80 | 3.50 | 80 |
| Burner Bubble | 2.85 | 3.55 | 80 |
| Wilson Staff | 3.05 | 3.65 | 83 |
| Cobra | 2.85 | 3.40 | 84 |
| Mizuno TC29 | 2.95 | 3.50 | 84 |
| Hogan H40 | 3.00 | 3.55 | 84 |
| Cleveland VAS | 3.22 | 3.85 | 84 |
| Titleist DCI | 3.00 | 3.50 | 85 |
| Tommy A 855 | 3.00 | 3.50 | 85 |
| McGregor Doctor | 3.20 | 3.75 | 85 |
| Bertha | 3.20 | 3.75 | 85 |
| Invention | 3.38 | 3.71 | 91 |

As shown in the foregoing table, the cavity of the present invention occupies a substantially greater portion of the combined blade and junction than is the case with conventional irons.

FIGS. 6–9 show an alternative embodiment of an iron 10*a* having an "inset hosel" 14*a*. This is another generally known clubhead configuration, and need not be described in further detail. As shown in FIGS. 6–9, in an offset hosel configuration the junction 16*a*, which constitutes the region denoted by broken lines J1–J2, includes a forwardly extending portion 17 that projects the hosel 14*a* forward of (i.e., so that it becomes offset from) the blade front face 18.

In the FIGS. 6–9 embodiment, the blade 12 may have the same configuration as in the embodiment of FIGS. 1–5, and includes a rearwardly facing cavity 22 defined by a blade perimeter wall 24. The blade cavity 22 joins a junction cavity 28*b* formed in the junction 16*a* by junction perimeter wall 26*a*. As in the case of junction cavity 28, the junction cavity floor 29*a* is preferably co-planar with the cavity floor 32.

Figure 9:
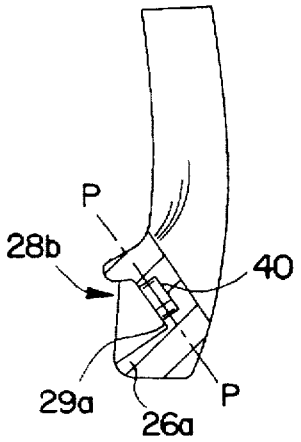
FIG. 9 is a sectional view of the clubhead, taken through lines 9—9 of FIG. 7.

In addition to the junction cavity 28*b*, in the embodiment of FIGS. 6–9 a negative weight cutout 40 is formed in the junction, extending below the junction cavity floor 29*a*, which can be seen in FIGS. 7 and 9. In FIG. 9, broken line P—P represents the location of the plane of the blade face 18.

Preferably, the cutout 40 represents a continuation of the profile of the weight pad 30, except that, whereas the portions 30*a*–30*b* of the weight pad in the blade 12 extend upwardly from the cavity floor 32, the negative weight cutout 40 extends below the junction cavity floor 29*a* into the body of the junction.

In FIG. 9, the preferred depth of the negative weight cutout 40 has been exaggerated. However, as shown, the cutout 40 can extend forward of the blade plane P—P. The embodiment of FIGS. 1–5 can include a similar cutout, e.g. curving up into the region 28*a*.

Figure 7:
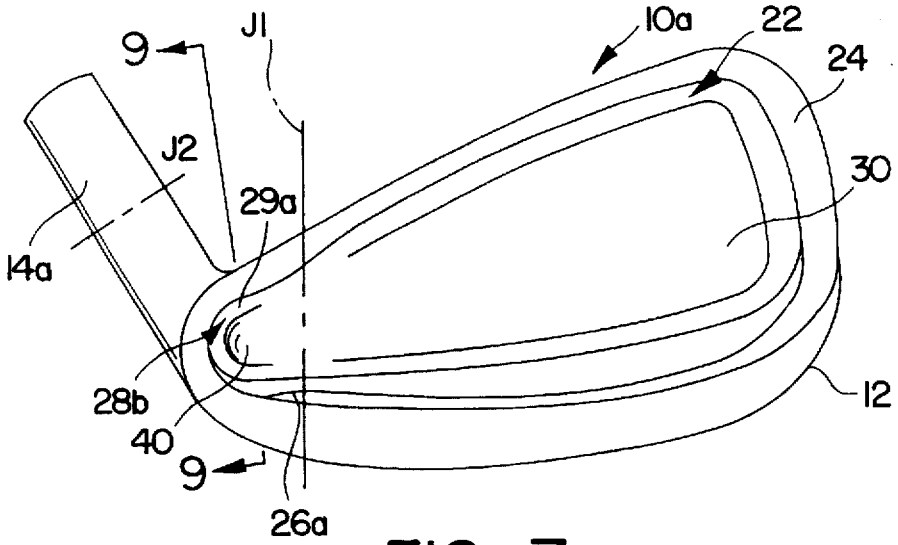
Figure 8:
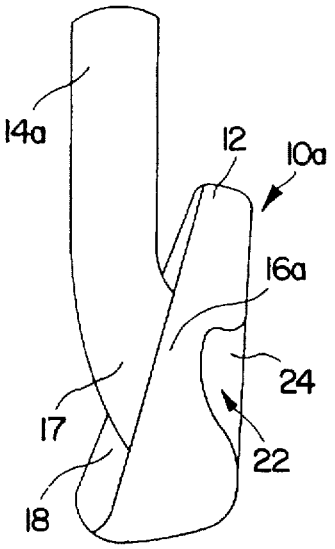
Figure 10:
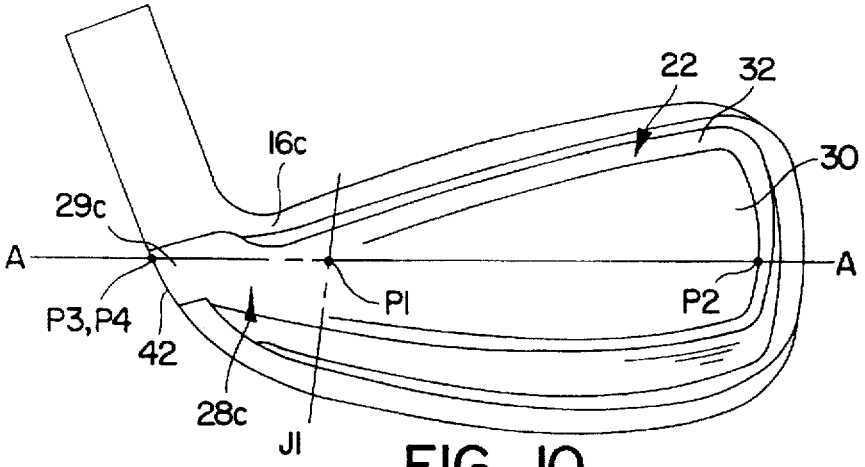
FIGS. 10–11 are a rear views of two additional embodiments.
Figure 11:
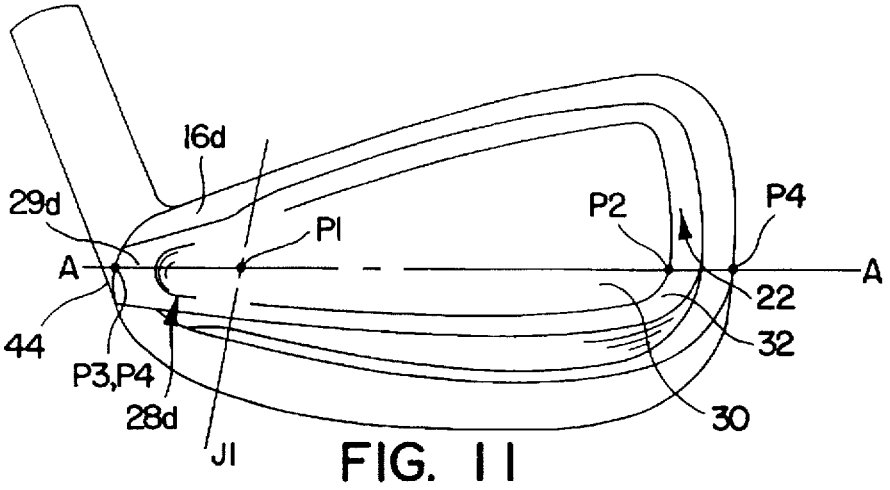

FIGS. 10–11 represent additional embodiments, corresponding to FIGS. 2 and 7, respectively, except that the junction cavities, 28*c* and 28*d*, extend in the heel direction completely to the rear edges, 42, 44, of the junctions 28*c*, 28*d*. In other words, in FIGS. 10–11, the points P3 and P5 are coincident, and the junction cavity length P3-P1 extends 100% of the length of the junction P1–P5. The junction cavity floors 29*c*, 29*d* are preferably coplanar with the cavity floor 32.

The foregoing represents preferred embodiments of the invention. Variations and modifications will be apparent to persons skilled in the art, without departing from the inventive concepts disclosed herein. For example, the size and shape of the blade and junction cavities can be modified as desired, as can the wall thicknesses of the respective perimeter walls defining the cavities. Also, the cross-sectional configuration of the weight pad can be changed as desired. In addition, while in the exemplary embodiments the clubhead, including weight pad, are cast as a single piece, it is possible to utilize the invention in a clubhead formed of multiple pieces, or a clubhead in which the blade, junction, and hosel are one piece, but the weight pad is formed separately. The latter allows the weight pad to be made of a different material than the clubhead, i.e., a heavier, more dense material, such as brass, tungsten, etc.). Moreover, while the weight pad is shown as a smooth, tongue shaped pad, the pad may have other appearances either for aesthetic or functional reasons. All such modifications and variations are intended to be within the skill of the art, as defined in the following claims.

I claim:

1. An iron-type golf clubhead, comprising a blade, having a heel end and a toe, and a planar blade face extending from the heel end towards the toe for striking a ball; a hosel for securing the clubhead to a shaft; and a junction extending from the heel end of the blade face initially in a generally toe-to-heel direction and connecting the blade to the hosel; wherein the blade includes a rearwardly facing blade cavity, extending generally in a heel-to-toe direction, defined by a blade cavity perimeter wall; and wherein the junction includes a rearwardly facing junction cavity that is coextensive with said blade cavity and is defined by a junction cavity perimeter wall which is a continuation of the blade cavity perimeter wall.

2. A golf clubhead according to claim 1, wherein the junction cavity has a length "LJC" of at least 0.1 inch.

3. A golf clubhead according to claim 1, wherein the junction cavity has a length "LJC" of at least 0.5 inch.

4. A golf clubhead according to claim 1, wherein the junction cavity has a length "LJC" that extends at least 17% of the length of the junction "LJ".

5. A golf clubhead according to claim 4, wherein the junction cavity has a length "LJC" that extends at least 50% of the length of the junction "LJ".

6. A golf clubhead according to claim 5, wherein the junction cavity has a length "LJC" that extends at least 85% of the length of the junction "LJ".

7. A golf clubhead according to claim 6, wherein the junction cavity has a length "LJC" that extends 100% of the length of the junction "LJ".

8. A golf clubhead according to claim 1, wherein the clubhead has a combined cavity length "LC" plus junction cavity length "LJC" that is at least 88% of the overall clubhead length "LJ" plus "LB".

9. A golf clubhead according to claim 8, wherein the clubhead has a combined cavity length "LC" plus junction cavity length "LJC" that is at least 90% of the overall clubhead length "LJ" plus "LB".

10. A golf clubhead according to claim 1, wherein the clubhead has a combined cavity length "LC" plus junction cavity length "LJC" of at least 3.3 inches.

11. A golf clubhead according to claim 1, wherein said blade cavity includes a blade cavity bottom surface, and wherein said junction cavity includes a junction cavity bottom surface that is coextensive with said blade cavity bottom surface.

12. A golf clubhead according to claim 1, wherein said blade cavity includes a blade cavity bottom surface, and further comprising a graduated weight pad contained within said blade cavity, the weight pad extending substantially the entire heel-to-toe distance of the blade cavity and projecting rearwardly from said blade cavity bottom surface.

13. A golf clubhead according to claim 12, wherein said junction cavity includes a junction cavity bottom surface that is coextensive with said blade cavity bottom surface.

14. A golf clubhead according to claim 13, wherein said junction cavity includes a cutout extending below said junction cavity bottom surface.

15. A golf clubhead according to claim 14, wherein the weight pad has a graduated profile, and wherein the cutout represents a continuation of the profile of the weight pad.

16. A golf clubhead according to claim 12, wherein said blade cavity has a top-to-bottom direction, and wherein said weight pad extends substantially the entire top-to-bottom distance of said blade cavity.

17. A golf clubhead according to claim 1, wherein the junction has a junction cavity floor and includes a point P5, representing a point on the junction outer surface located furthest away from the toe, measured in a direction along the cavity floor and parallel to the ground when the clubhead is at its normal lie position; and wherein the junction cavity perimeter wall includes a discontinuity at least at point P5 such that the junction cavity extends out the heel end of the junction.

18. A golf clubhead according to claim 1, wherein the blade includes a sole having a bottom surface, a leading edge, a rear edge surface which faces generally away from said leading edge, and a centerline extending from the leading edge to the rear edge surface, through a touchpoint where the blade contacts the ground in its normal lie position, wherein the rear edge surface is formed by a bottom portion of the perimeter wall and has a rounded surface, and wherein the rear edge surface includes a pair of flattened surfaces disposed on either side of the centerline and lying forward of the rounded surface.

19. A golf clubhead according to claim 1, wherein said junction cavity includes a junction cavity floor, wherein said hosel has a hosel axis, and wherein said junction cavity floor intersects a plane which is oriented perpendicular to said junction cavity floor and which contains said hosel axis.

20. A golf clubhead according to claim 19, wherein said hosel axis does not intersect said blade face.

21. An iron-type golf clubhead comprising a blade, having a heel end and a toe; a hosel for securing the clubhead to a shaft; and a junction extending from the heel end of the blade face and connecting the blade to the hosel; wherein the blade includes a rearwardly facing blade cavity, extending generally in a heel-to-toe direction, defined by a blade cavity perimeter wall, wherein said blade cavity includes a blade cavity bottom surface, and further comprising a graduated weight pad contained within said blade cavity, the weight pad extending substantially the entire heel-to-toe distance of the blade cavity and projecting rearwardly from said blade cavity bottom surface.

22. A golf clubhead according to claim 21, wherein said graduated weight pad has a height, in a direction perpendicular to said blade face, that varies in a toe-to-heel direction.

23. A golf clubhead according to claim 22, wherein the height of said graduated weight pad further varies in a vertical direction.

24. A golf clubhead according to claim 21, wherein said blade cavity has a top-to-bottom direction, and wherein said weight pad extends substantially the entire top-to-bottom distance of said blade cavity.

* * * * *